US011242747B2

(12) United States Patent
Al-Malki et al.

(10) Patent No.: US 11,242,747 B2
(45) Date of Patent: Feb. 8, 2022

(54) DOWNHOLE PROBE TOOL

(71) Applicant: Saudi Arabian Oil Company, Dhahran (SA)

(72) Inventors: Bander S. Al-Malki, Dammam (SA); Faisal M. Sarwi, Dhahran (SA); Ismail Adebiyi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/825,639

(22) Filed: Mar. 20, 2020

(65) Prior Publication Data

US 2021/0293144 A1 Sep. 23, 2021

(51) Int. Cl.
*E21B 49/10* (2006.01)
*E21B 49/08* (2006.01)

(52) U.S. Cl.
CPC ..... *E21B 49/10* (2013.01); *E21B 49/088* (2013.01)

(58) Field of Classification Search
CPC .... E21B 49/10; E21B 49/088; E21B 17/1078; E21B 17/1021; E21B 17/1014
See application file for complete search history.

(56) References Cited

U.S. PATENT DOCUMENTS 2,965,176 A * 12/1960 Brieger ..... E21B 49/10 166/63
4,962,815 A 10/1990 Schultz et al.
5,293,945 A * 3/1994 Rosenhauch ..... E21B 17/1014 175/325.2
5,335,542 A * 8/1994 Ramakrishnan .... E21B 33/1246 166/250.02
5,934,374 A 8/1999 Hrametz et al.
6,026,915 A * 2/2000 Smith ..... E21B 17/1078 175/50
6,230,557 B1 * 5/2001 Ciglenec ..... E21B 49/10 73/152.01
6,729,399 B2 * 5/2004 Follini ..... E21B 17/1014 166/264
7,080,552 B2 * 7/2006 Jones ..... E21B 17/1014 73/152.27
7,114,385 B2 10/2006 Fisseler et al.
(Continued)

FOREIGN PATENT DOCUMENTS

EP 978630 A2 * 7/1999 ..... E21B 49/00
GB 2445204 7/2008

OTHER PUBLICATIONS

PCT International Search Report and Written Opinion in International Appln. No. PCT/US2021/022782, dated Jun. 16, 2021, 13 pages.

*Primary Examiner* — Jennifer H Gay
(74) *Attorney, Agent, or Firm* — Fish & Richardson P.C.

(57) ABSTRACT

A downhole fluid sampling system includes a tool body to attach to a tubing string, and multiple probe pads having a curved shape and disposed circumferentially about a section of the tool body in a helical gear pattern about a central longitudinal axis of the tool body. Each probe pad includes probes on an external surface of the respective probe pad, and each probe can contact and engage a wall of a wellbore and receive a flow of formation fluid from the wall of the wellbore. An outer surface of the tool body includes multiple channels disposed circumferentially about the section of the tool body and between the probe pads. The channels direct fluid flow along the tool body.

20 Claims, 5 Drawing Sheets

(56) References Cited

U.S. PATENT DOCUMENTS 7,114,562 B2 * 10/2006 Fisseler ..... E21B 17/1078 166/250.02
7,121,338 B2 10/2006 Zuilekom et al.
7,128,144 B2 10/2006 Fox et al.
7,260,985 B2 8/2007 Gilbert et al.
7,311,142 B2 * 12/2007 Fisseler ..... E21B 17/1078 166/100
7,810,573 B2 * 10/2010 Baird ..... E21B 10/26 166/378
8,015,867 B2 * 9/2011 Kerr ..... E21B 49/10 73/152.26
8,770,286 B2 7/2014 Briquet et al.
9,376,910 B2 * 6/2016 Proett ..... E21B 49/10
9,784,048 B2 * 10/2017 Moyer ..... E21B 41/0078
10,329,908 B2 6/2019 Fox et al.
2003/0098156 A1 * 5/2003 Follini ..... E21B 17/1014 166/264
2004/0011525 A1 * 1/2004 Jones ..... E21B 49/008 166/264
2005/0109538 A1 * 5/2005 Fisseler ..... E21B 17/1078 175/20
2005/0257934 A1 * 11/2005 Baird ..... E21B 37/02 166/380
2006/0065394 A1 * 3/2006 Clark ..... G01V 3/30 166/254.2
2007/0039730 A1 * 2/2007 Fisseler ..... E21B 17/1078 166/254.2
2008/0115574 A1 5/2008 Meek
2008/0156487 A1 * 7/2008 Zazovsky ..... E21B 47/01 166/264
2009/0158837 A1 6/2009 Meek et al.
2010/0018704 A1 * 1/2010 Zazovsky ..... E21B 47/01 166/264
2010/0083748 A1 * 4/2010 Kerr ..... E21B 49/10 73/152.26
2013/0213645 A1 * 8/2013 Proett ..... E21B 49/10 166/250.17
2015/0252630 A1 * 9/2015 Moyer ..... E21B 17/006 166/301
2016/0053612 A1 2/2016 Proett et al.
2016/0138396 A1 5/2016 Morgan et al.
2016/0305240 A1 * 10/2016 Fox ..... E21B 47/12
2019/0055792 A1 2/2019 Sui et al.
2019/0345822 A1 * 11/2019 Pfutzner ..... E21B 47/017
2020/0355034 A1 * 11/2020 Zhou ..... E21B 17/1021

* cited by examiner

DOWNHOLE PROBE TOOL

TECHNICAL FIELD

This disclosure relates to formation fluid testing with downhole testing tools.

BACKGROUND

In the oil and gas industries, some wellbores undergo formation fluid testing to determine if hydrocarbons can be produced from a reservoir in a cost-effective manner. Fluid testing often requires fluid sampling tools, such as probe tools, to be used in downhole wellbore applications to receive and test the formation fluid.

SUMMARY

This disclosure describes sampling formation fluids in a wellbore and downhole fluid sampling systems.

Some aspects of the disclosure encompass a downhole fluid sampling system including a tool body to attach to a tubing string, multiple probe pads each having a curved shape and disposed circumferentially about a section of the tool body in a helical gear pattern about a central longitudinal axis of the tool body, and multiple channels in an outer surface of the tool body. Each probe pad includes one or more probes on an external surface of the respective probe pad, and each of the one or more probes is configured to contact and engage a wall of a wellbore and receive a flow of formation fluid from the wall of the wellbore. The multiple channels are disposed circumferentially about the section of the tool body between the probe pads, the channels to direct fluid flow along the tool body.

This, and other aspects, can include one or more of the following features. The probe pads can be connected to the tool body with probe arms, the probe pads to radially extend away from the tool body from a first, retracted position to a second, radially extended position. The downhole fluid sampling system can include a hydraulic actuator system connected to the probe pads and configured to radially actuate the plurality of probe pads. The downhole fluid sampling system can further include a mechanical pad retracting system connected to the probe pads, the mechanical pad retracting system configured to radially actuate the probe pads. The mechanical pad retracting system can include at least one spring, the at least one spring configured to retract at least one probe pad of the plurality of probe pads. The probe pads can be distributed evenly about the section of the tool body. The probe pads can include four probe pads. Each probe pad can include three probes. The downhole fluid sampling system can further include a wet connector channel extending within and longitudinally along the tool body, and one or more bypass ports extending within and longitudinally along the tool body, the one or more bypass ports being fluidly separate from the wet connector channel, the one or more bypass ports including one or more lateral port openings in an outer surface of the tool body. The one or more bypass ports can include four bypass ports along a majority of the longitudinal length of the tool body. The one or more lateral port openings can be positioned longitudinally downhole of the probe pads. Each channel can include a concave profile configured to promote fluid flow along the respective channel.

Some aspects of the disclosure encompass a method for sampling fluid downhole in a wellbore. The method includes disposing a downhole fluid sampling system in a wellbore, the downhole fluid sampling system including a tool body configured to be attached to a tubing string, engaging a formation wall of the wellbore with one or more probes on a radially external surface of a plurality of probe pads, each probe pad of the plurality of probe pads having a curved shape, and the plurality of probe pads disposed circumferentially about a section of the tool body in a helical gear pattern about a central longitudinal axis of the tool body, receiving, through the one or more probes, a fluid sample from the formation wall, and guiding wellbore fluid across the tool body with a plurality of channels in an outer surface of the tool body, the plurality of channels disposed circumferentially about the section of the tool body between the probe pads of the plurality of probe pads.

This, and other aspects, can include one or more of the following features. The method can include radially extending the plurality of probe pads from the tool body from a first, retracted position to a second, radially extended position, wherein the engaging is in response to the radially extending. Radially extending the plurality of probe pads can include actuating a hydraulic actuator system coupled to the plurality of probe pads to radially extend the plurality of probe pads to the second, extended position. The method can further include, in response to radially extending the plurality of probe pads, radially retracting the plurality of probe pads with a mechanical pad retracting system to the first, retracted position. The method can include circulating fluid downhole of the probe pads through one or more bypass ports extending within and longitudinally along the tool body, the one or more bypass ports including one or more lateral port openings in an outer surface of the tool body. Circulating fluid downhole of the probe pads through the one or more bypass ports can include circulating well kill fluid through the one or more bypass ports and into the wellbore downhole of the probe pads.

In certain aspects, a downhole fluid sampling system includes a tool body configured to attach to a tubing string, a central channel extending within and longitudinally along the tool body, one or more bypass ports extending within and longitudinally along the tool body, the one or more bypass ports being fluidly separate from the central channel, the one or more bypass ports including one or more lateral port openings in an outer surface of the tool body, and multiple probe pads each having a curved shape and disposed circumferentially about a section of the tool body in a helical gear pattern about a central longitudinal axis of the tool body. Each probe pad incudes one or more probes on an external surface of the respective probe pad, and each of the one or more probes is configured to contact and engage a wall of a wellbore and receive a flow of formation fluid from the wall of the wellbore.

This, and other aspects, can include one or more of the following features. The downhole fluid sampling system can include multiple channels in an outer surface of the tool body and disposed circumferentially about the section of the tool body between the probe pads. The plurality of channels can be configured to direct fluid flow along the tool body. The probe pads can be connected to the tool body with probe arms, the probe pads being configured to radially extend away from the tool body from a first, retracted position to a second, radially extended position.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes a downhole probe tool with spiral-shaped probe pads positioned around the probe tool, fluid channels between the probe pads to direct fluid along the probe tool and between the probe pads, and fluid bypass ports through the probe tool for downhole fluid circulation through and downhole of the probe tool. The probe pads are connected to the probe tool and positioned circumferentially around the body of the probe tool in a helical gear pattern. The outer surface profile of each probe pad is curved to substantially match (for example, approach the approximate profile of) a curvature of a surrounding formation wall of a wellbore. Each probe pad includes one or more probes on an external surface of the probe pad. The probe(s) can contact and engage the formation wall of the wellbore and receive formation fluid to be sampled and tested, for example, within the probe tool, elsewhere along a tubing string, or at a separate location topside of the wellbore. The channels are formed in an outer surface of the tool body of the probe tool, and are disposed circumferentially about the tool body and between the probe pads. The channels promote and direct fluid flow along the tool body, and can increase a flow area along the probe tool during a sampling operation of the probe tool, during a drilling operation of a tubing string that includes the probe tool, or other downhole well operations. The fluid bypass ports fluidly connect to the wellbore via lateral ports openings below, or downhole of, the probe pads. The bypass ports provide a fluid channel to bypass a fluid through the well tool to allow circulation of fluid below the well tool, for example, in the case of a stuck pipe or a stuck logging tool in the wellbore. In some examples, the fluid bypass ports allow for a well kill fluid, acid pills, or other fluid to circulate through the well string and through the well tool to a wellbore location downhole of the probe pads without disrupting or affecting a fluid sampling operation with the probe pads.

Conventional sampling tools for downhole wellbore applications often incorporate inflatable packer elements to isolate portions of a wellbore and enable the collection of fluid samples. However, placing and setting inflatable packer elements are time-consuming and increase a risk of nonproductive time, for example, when inflatable packers cause stuck pipes and stuck tools in the wellbore. These occurrences require time and money to free the stuck tool or pipe, and may result in the tool being lost in the wellbore or abandoned. The downhole probe tool of this disclosure provides for probe sampling of wellbores, including tight reservoirs, and can minimize the risk associated with sampling by providing stand-off clearance between a tool and the formation wall and maintain a large flow area in the wellbore around the tool, for example, without incorporating inflatable packers or other straddle packers.

Figure 1:
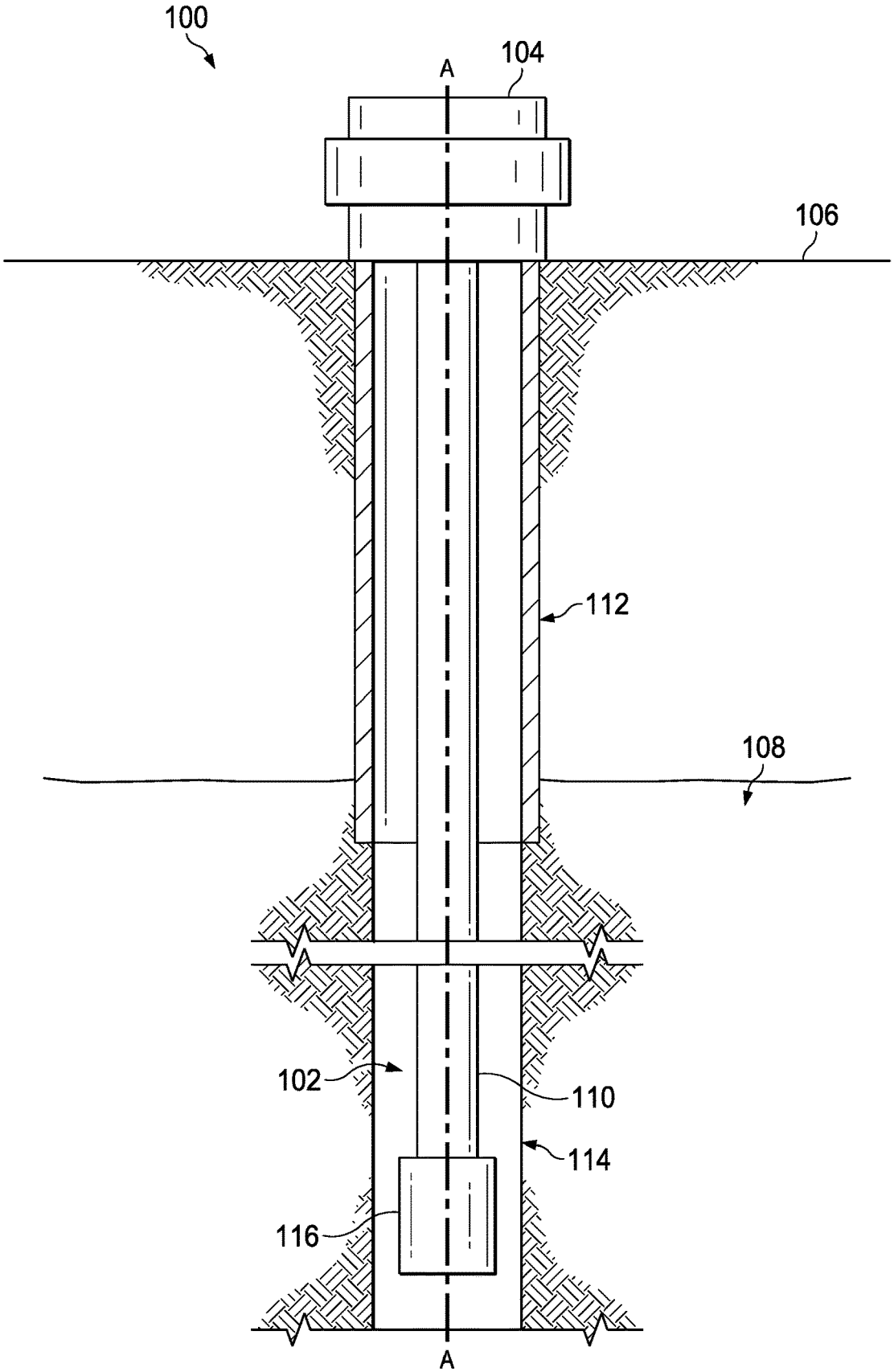
FIG. 1 is a schematic partial cross-sectional side view of an example well system including an example well tool.

FIG. 1 is a schematic partial cross-sectional side view of an example well system 100 that includes a substantially cylindrical wellbore 102 extending from a well head 104 at a surface 106 downward into the Earth into one or more subterranean zones of interest 108 (one shown). The example well system 100 includes a vertical well, with the wellbore 102 extending substantially vertically from the surface 106 to the subterranean zone 108. The concepts herein, however, are applicable to many other different configurations of wells, including horizontal, slanted, or otherwise deviated wells. A well string 110 is shown as having been lowered from the surface 106 into the wellbore 102. In certain instances, after some or all of the wellbore 102 is drilled, a portion of the wellbore 102 is lined with lengths of tubing, called casing 112. The wellbore 102 can be drilled in stages, and the casing 112 may be installed between stages. The casing 112 can include a series of jointed lengths of tubing coupled together end-to-end or a continuous (for example, not jointed) coiled tubing. The casing 112 forms the cased section of the wellbore 102. In some examples, the well system 100 excludes casings, such as casing 112, and the wellbore 102 is at least partially or entirely open bore. The section(s) of the wellbore 102 exposed to the adjacent formation (for example, without casing or other permanent completion) form the open hole section 114 of the wellbore 102.

In the example well system 100 of FIG. 1, the well string 110 is a testing string 110 that includes a well tool 116, such as a fluid sampling system with a probe tool, at a downhole end of the testing string 110. The well tool 116 is positioned in the wellbore 102 adjacent the open hole section 114 of the wellbore. The well tool 116 selectively performs fluid sampling operations with one or more probes, and is rugged enough to withstand the harsh environment of the wellbore 102. In some implementations, the testing string 110 is made up at least partially of drill piping, where the well tool 116 couples to the drill piping. The well tool 116 can couple to the tubing of the testing string 110 with a threaded connection or other appropriate connection.

In some implementations, the example well system 100 can include another type of well string 110 during another stage of well operation, where the well tool 116 is disposed on this other type of well string. For example, the well system 100 can include a production well, a well being drilled, a well being cased and cemented, a well being tested, or a well during other well operations, and can include a wireline, drill string, completion string, production string, casing tubing, testing string, or another type of well string. In some implementations, the well tool 116 is disposed on a drill string that also includes a bottom hole assembly (BHA) with a drill bit at a downhole end of the drill string, where the well tool 116 is positioned on the drill string uphole of the BHA. The well tool 116 is rugged enough to withstand the harsh wellbore environment and to be included on an active drill string.

The well tool 116 can be disposed at various locations on the well string 110. In some examples, the well tool 116 is disposed at a downhole end of the well string 110, directly above (for example, directly uphole of) a BHA of a well string, or disposed separate from and farther uphole of the downhole end of the well string 110, such as adjacent to the casing 112.

Figure 2:
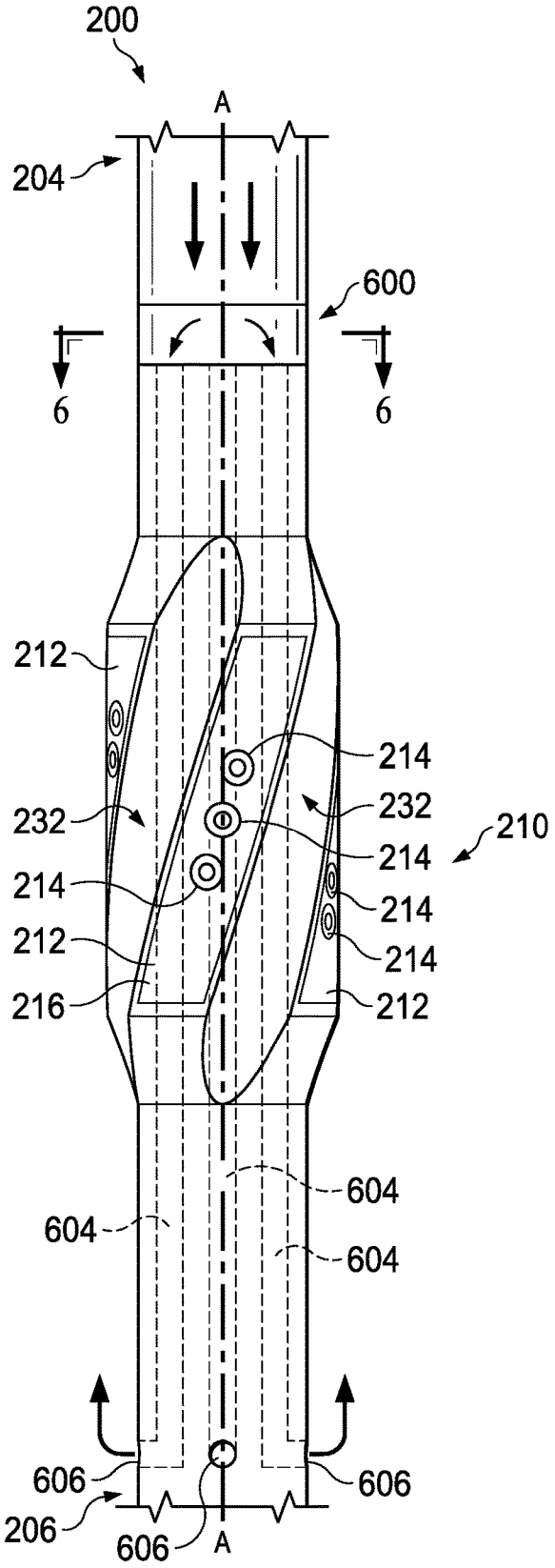
FIG. 2 is a schematic side view of an example well tool that can be used in the example well system of FIG. 1.

FIG. 2 is a schematic side view of an example well tool 200 that can be used in the example well system 100 of FIG. 1, such as the well tool 116 of FIG. 1. The example well tool 200 can define a fluid sampling system, and can be disposed on a tubing string, such as the testing string 110 of FIG. 1, and disposed within a wellbore substantially along longitudinal axis A-A. The well tool 200 can be positioned adjacent to an open hole section (for example, open hole section 114) of the wellbore and adjacent to a zone of interest (for example, zone of interest 108) of the wellbore. The zone of interest can be a portion of the wellbore adjacent a fluid-producing formation, where the well tool 200 can engage a wall of the formation of the wellbore and receive fluid samples from a portion of the zone of interest. The example well tool 200 can be disposed in the wellbore and positioned adjacent to an open hole section, a cased section, another section of the wellbore, or a combination of these sections.

The example well tool 200 includes a generally cylindrical tool body 202 positioned about a central longitudinal axis A-A. The tool body 202 has a first, uphole longitudinal end 204 and a second, downhole longitudinal end 206, and can connect to tubing of a well string, such as well string 110 of FIG. 1, on the first longitudinal end 204, the second longitudinal end 206, or both. In some examples, the tool body 202 includes threading or other structures to engage and connect to tubing or other well tools at the first longitudinal end 204, second longitudinal end 206, or both. The example well tool 200 also includes a probe module 210 coupled to the tool body 202, and a wet connector sub 600, described in more detail later with reference to FIG. 6.

The probe module 210 is coupled to the tool body 202 and includes multiple probe pads 212 disposed circumferentially about a section of the tool body 202. The probe pads 212 have a curved shape, or spiral shape, and are disposed about the tool body 202 in a helical gear pattern such that each probe pad 212 spirals along the tool body 202, imitating the cylindrical gear profile of a helical gear. For example, a probe pad 212 has an elongate body that curves along an arc between a first longitudinally upper end and a second, opposite longitudinally lower end, forming a partial helical shape. In some implementations, between its upper longitudinal end and lower longitudinal end, a probe pad 212 curves along an arc a dimension between about 40 degrees and about 180 degrees about the tool body 202. For example, in the example well tool 200 of FIG. 2, the probe pads 212 extend along an arc of about 90 degrees between the respective upper longitudinal end and lower longitudinal end of the probe pad. In some examples, the arc dimension can be different for one or more or all of the probe pads 212 of the well tool 200, such as arc dimensions of 40 degrees, 60 degrees, 90 degrees, 120 degrees, 180 degrees, or another total arc dimension.

In the example well tool 200 of FIG. 2, the probe module 210 includes four probe pads 212 evenly and symmetrically distributed about the circumference of the tool body 202. However, the number of probe pads 212 and distribution of the probe pads 212 can be different. For example, the well tool 200 can include two, three, four, five, or more probe pads 212 distributed evenly or unevenly about the tool body 202. The probe pads 212 can be rigid or can have some flexibility. For example, the probe pads 212 can be somewhat flexible to better match an inner surface profile of an adjacent wall of the wellbore, since the inner surface profile can vary. This flexibility of the probe pad can provide a more reliable seal against the wellbore wall during a fluid sampling operation.

Figure 3:
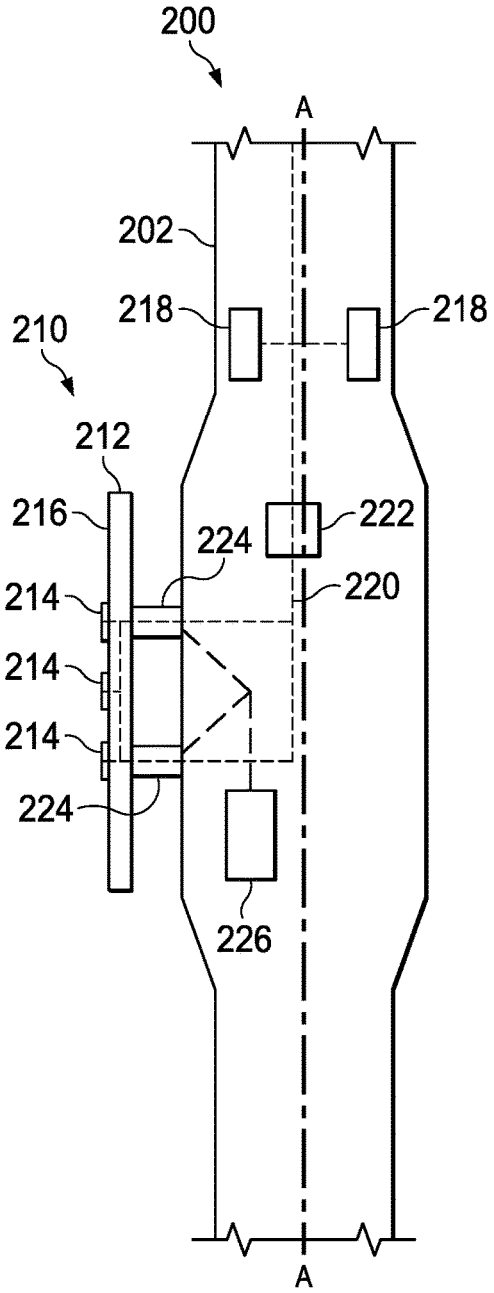
FIG. 3 is a partial, schematic, cross-sectional side view of the example well tool of FIG. 2.

Each of the probe pads 212 include one or more probes 214 (three shown on a single probe pad 212 in FIG. 2) on an external surface 216 of the probe pads 212. The probes 214 can contact and engage a formation wall of the wellbore and receive a flow of formation fluid from the wall of the wellbore, where the formation fluid can be sampled and tested. FIG. 3 is a partial, schematic, cross-sectional side view of the example well tool 200 and probe module 210 of FIG. 2, and shows certain features of the well tool 200 and probe module 210. Referring to both FIGS. 2 and 3, a sample flow line 220 formed at least partially within the tool body 202 directs the fluid samples to a desired location. In some implementations, the example well tool 200 includes sample bottles 218 housed within the tool body 202 to receive and store the fluid samples. In certain implementations the fluid samples can be directed to an uphole location separate from the example well tool 200 though a sample fluid channel (for example, the sample flow line 220), or directed to a tophole location at a surface of the well (for example, via sample flow line 220). In some examples, the example well tool 200 also includes a fluid pump 222 to pump the fluid samples to the sample bottle(s) 218 or to a different desired location elsewhere along the tubing string or at a tophole location. The fluid samples can be tested with fluid testing equipment (not shown) housed within the well tool 200, located elsewhere along a tubing string, or located at a separate location topside of the wellbore.

Each of the probes 214 can be operated individually, all together, or in subsets, in order to improve a sampling time and operational efficiency of a fluid sampling operation. For example, the example tool 200 can receive fluid samples from just a portion of a formation wall while avoiding fluid sampling from an adjacent portion of the formation wall by activating only one or a subset of probes 214 instead of activating all of the probes 214 at once. In some instances, each probe 214, or all probes 214 on a single probe pad 212, are connected to a dedicated fluid pump (for example, fluid pump 222) electrically coupled to and controlled by a controller. The controlled operation of the fluid pumps provides for separate control of probes from one probe pad 212 compared to probes of a different probe pad 212. While the example well tool 200 of FIG. 3 shows just one fluid pump 222 connected to the three probes 214 on the probe pad 212, the example well tool 200 can include additional fluid pumps connected to more, fewer, or different probes 214. For example, each probe 214, or a group of probes 214 on each probe pad 212, can connect to its own dedicated fluid pump such that each probe 214 (or group of probes 214) can be individually controlled, and the fluid samples from the probe(s) 214 can be kept separate from fluid samples of other probes 214 on the tool 200. In some implementations, all probes 214 can be activated at the same time for multiple fluid sampling operations, which can save time during a testing operation. In certain implementations, each probe 214 has its own dedicated sensor and dedicated fluid pump. Based on rock properties of the formation, such as porosity, permeability, and fluid mobility, the probes 214 can be operated individually, all together, or in subsets, for example, to improve a sampling time and operational efficiency of a fluid sampling operation.

The probe pads 212 can radially extend away from the tool body 202 from a first, retracted position, as shown in FIG. 2, to a second, radially extended position relative to the tool body 202 toward a wellbore wall, for example, in order to allow one or more or all of the probes 214 to engage a formation wall and receive sample fluid from a formation. The probe pad 212 of FIG. 3 is shown in the second, radially extended position. The probe pads 212 are connected to the tool body 202 with probe arms 224 (two shown) that can radially extend, and in some instances radially retract, the probe pads 212 from the tool body 202. The probe arms 224 also house part of the sample flow line 220 to allow the fluid samples received at the probes 214 to flow through the probe arms 224 into the tool body 202 and toward a desired location, for example, to the sample bottles 218. Though FIG. 3 shows two probe arms 224 to support each probe pad 212, the number of probe arms 224 can vary. For example, each probe pad 212 can be supported on the tool body 202 with one, two, three, or more probe arms 224 between the respective probe pad 212 and the tool body 202.

Figure 4A:
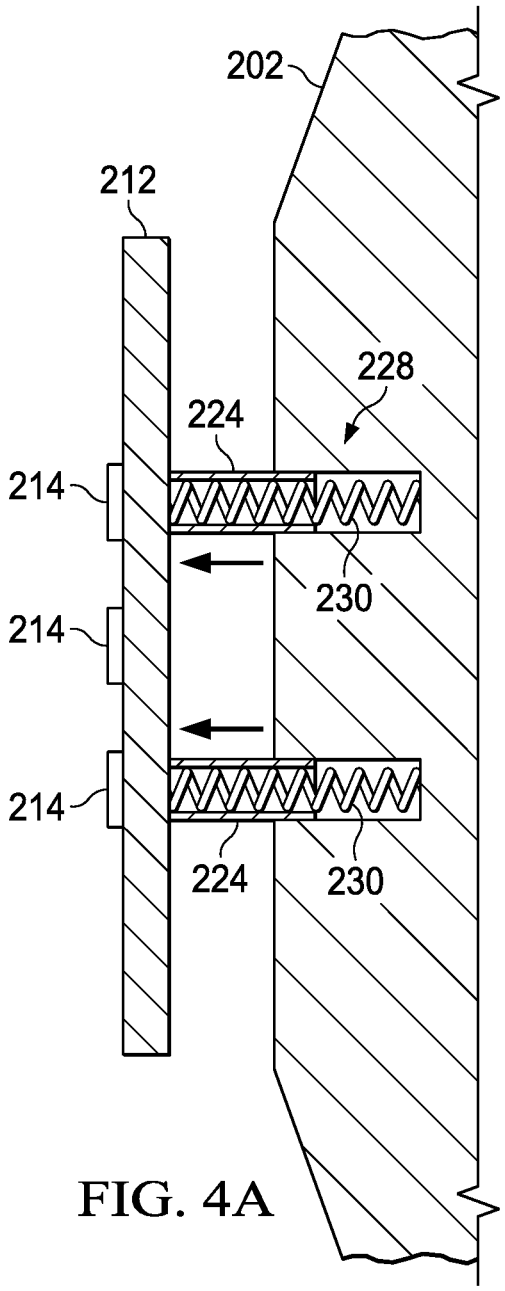
FIGS. 4A and 4B are partial cross-sectional schematic views of the example well tool of FIG. 3 showing an example probe pad in the radially extended position and in the retracted position, respectively.
Figure 4B:
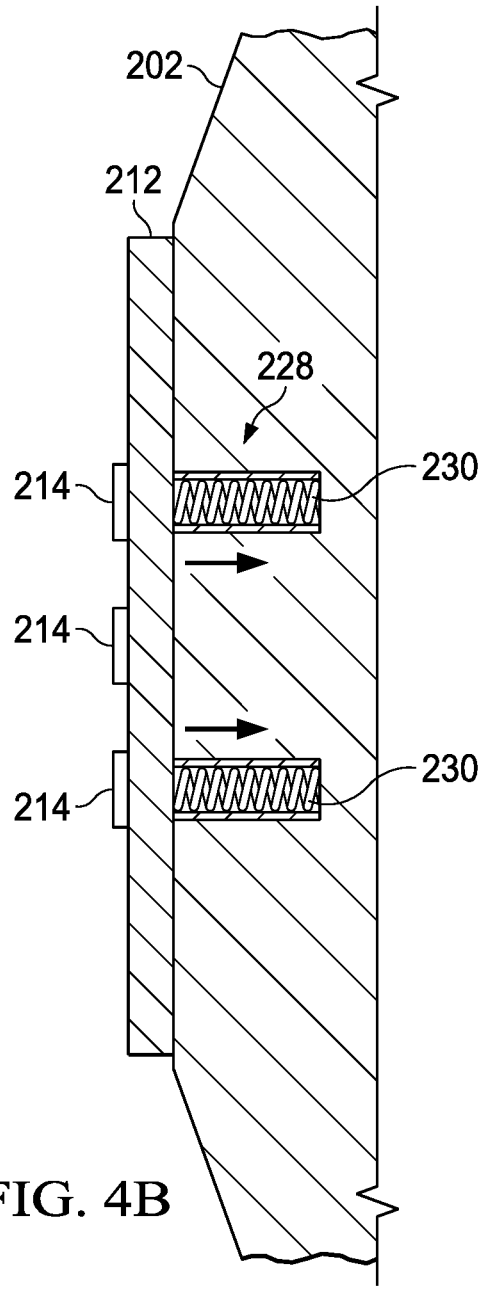

The probe arms 224 are hydraulically actuated to move the probe pads 212 between the radially extended position and the retracted position with a hydraulic actuator system. The probe arms 224 connect to a hydraulic actuator 226 to move the probe arms 224. The hydraulic actuator 226 connects to and controls the radial position of each of the probe pads 212, and can control the probe pads 212 to move independently of each other or to move together. The hydraulic actuator 226 can include a hydraulic pump positioned locally, such as adjacent to, the probe arms 224 to maintain a hydraulic pressure of the actuator 226 to radially retract, radially expand, or maintain radial position of one or more or all of the probe pads 212. In some implementations, the probe arms 224 include telescoping tubular elements connected on one side to the tool body 202 and on an opposite side to a respective probe pad 212, to support the probe pads 212 during radial extension and radial retraction of the probe pads 212. In the retracted position, the probe arms 224 are at least partially (for example, partially or completely) embedded within the tool body 202, as shown in FIG. 4B. In the radially extended position, one or more tubular elements of the probe arms 224 telescope outward from the tool body 202 to position a respective probe pad 212 in the radially extended position, as shown in FIG. 4A. In some instances, the probe arms 224 are cylindrical and straight, and extend and retract along a radial direction (for example, a radial direction from center axis A-A). In certain instances, one or more probe arms 224 connected to a probe pad 212 can be curved or in a direction that is angled offset from a radial of the central axis A-A, in order to allow for the telescoping movement of the probe arms 224 to match the curved, partially helical shape of the probe pad 212.

As described earlier, FIGS. 4A and 4B are partial cross-sectional schematic views of one of the probe pads 212 and its respective probe arms 224 supporting the probe pad 212 on the tool body 202. FIG. 4A shows the probe pad 212 in the radially extended position, and FIG. 4B shows the probe pad 212 in the retracted position. In some implementations, the example well tool 200 includes a mechanical pad retracting system 228 connected to the probe pads 212. The mechanical pad retracting system 228 can assist or back up the hydraulic actuator system in radially actuating the probe pads 212 between the extended position and the retracted position. The mechanical pad retracting system 228 includes a mechanical actuator to bias the probe pad 212 toward its retracted position. For example, in the case of hydraulic failure of the hydraulic actuator 226, the mechanical pad retracting system 228 biases the probe pads 212 to their retracted position. This bias can aid in avoiding the well tool from getting stuck in a wellbore, for example, by biasing the probe pads 212 into their retracted positions in the event of hydraulic failure, as opposed to their radially extended positions which can cause the tool to get stuck in the wellbore. In some examples, the mechanical pad retracting system 228 includes a spring 230 (two shown) within one or each of the probe arms 224, where the spring(s) 230 biases the probe pad 212 toward its retracted position against the tool body 202. The spring 230 connects on one end to the probe pad 212 and on its other end to the tool body 202. The spring(s) 230 of this mechanical pad retracting system 228 is fitted within the probe arm(s) 224, and provides a bias force on the probe pad(s) 212 toward the retracted position of the probe pads 212. The hydraulic actuator system (including the hydraulic actuator 226) can provide a force on the probe pads 212 that is greater than the spring bias of the spring 230 in order to move and maintain the probe pads 212 in their radially extended position. The bias force from the springs 230 provides a back up force or an assisting force in instances when the probe pads 212 are to be moved or maintained in their radially retracted position.

Referring back to FIG. 2, multiple channels 232 are formed in an outer surface of the tool body 202 between the probe pads 212 to promote fluid flow and increase flow area along the tool body 202 and probe module 210 and between the probe pads 212. The channels 232 are disposed circumferentially about the section of the tool body 202 between the probe pads 212. The curved spiral shape of the channels 232 mirror the curved spiral shape of the adjacent probe pads 212, since the channels 232 reside in the space between adjacent probe pads 212. In some implementations, the channels 232 include a concave surface profile, for example, a concave surface profile as viewed from a longitudinal cut section perpendicular to the axis A-A. The concave surface profile of each channel 232 promotes fluid flow along the respective channel.

Figure 5:
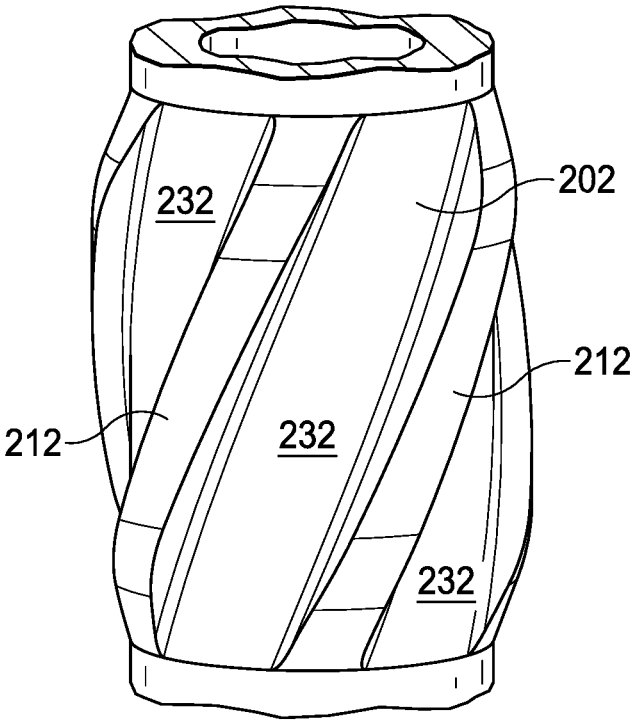
FIG. 5 is a partial perspective and schematic view of the example well tool of FIG. 2 showing example channels.

FIG. 5 is a partial perspective and schematic view of the example well tool 200 showing the channels 232. The probe pads 212 are shown schematically, and the channels 232 are the space between the probe pads 212. The channels 232 provide a junk slot area that increases fluid flow area longitudinally across the tool body 202. The channels 232 are large volume flow channels capable of more readily carrying and directing formation cuttings away from the well tool 200 as the cuttings flow in an uphole direction across the example well tool 200, for example, during a drilling operation of the wellbore. In some examples, the channels 232 provide minimal obstruction during a tripping out operation of the example well tool 200. The spiral design of the probe pads 212 and the channels 232 allows for better flow distribution around the tool, for example, distribution of drilling fluid with drilled formation cuttings during a drilling operation of the wellbore. In some instances of a stuck well tool, the spiral design can improve the chance to free the stuck tool, for example, when an acid or another freeing agent introduced to the wellbore around the stuck tool, since the spiral design provides good distribution across the stuck point of the tool.

In some implementations, the direction of the spiral curve of the channels 232 follows the rotation of the well tool 200 during operation, for example, during a drilling operation as the well tool 200 rotates about longitudinal axis A-A. The direction of the spiral curve of the channels 232 can promote and better direct fluid flow longitudinally across the tool body 202, such as when the tool body 202 rotates during well operations, while still promoting fluid flow across the tool body 202 in instances when the tool body 202 does not rotate. In certain implementations, the arc dimension of the probe pads 212 (described earlier) and the channels 232 can be determined based at least in part on an intended wellbore operation. For example, in well operations involving high rotational speeds of the well tool 200, the arc dimension can be greater (such as greater than 90 degrees) to promote fluid flow across the well tool 200; in well operations involving low rotational speeds of the well tool 200, the arc dimension can be less (such as less than or equal to 90 degrees) to promote fluid flow across the example well tool 200.

Figure 6:
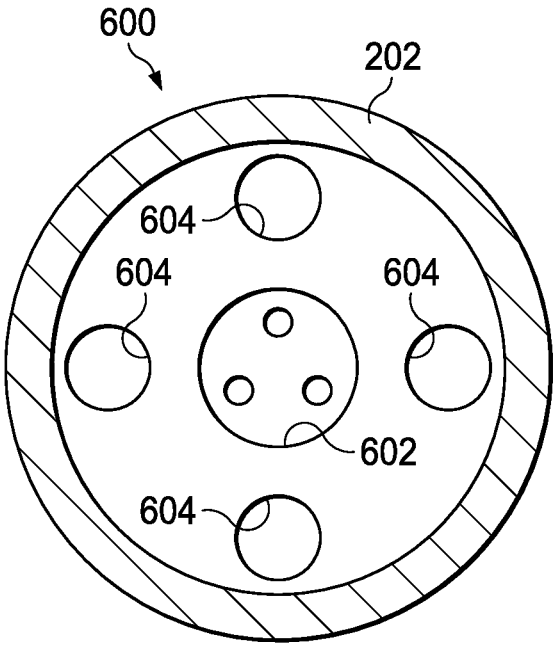
FIG. 6 is a cross-sectional top view of the wet connector sub of the example well tool of FIG. 2.

FIG. 6 is a cross-sectional top view of the wet connector sub 600 of FIG. 2. The wet connector sub 600 provides the example well tool 200 with circulation capabilities, allowing a fluid to circulate downhole of the probe module 210 (specifically, downhole of the probe pads 212) during a sampling operation and while the well tool 200 is stationary within a wellbore. Referring to both FIGS. 2 and 6, the wet connector sub 600 is positioned uphole of the probe module 210, and includes a wet connector channel 602 extending within and longitudinally along the tool body 202 and multiple bypass ports 604 (four shown) extending within and longitudinally along the tool body 202. The wet connector channel 602 and bypass ports 604 are fluidly separate from each other, from the probe module 210, and from the sample flow line 220. The wet connector channel 602 and bypass ports 604 each extend longitudinally along the tool body 202 and longitudinally across the probe module 210 without disrupting or affecting sampling operations performed by the probe module 210. The bypass ports 604 are shown as evenly distributed within and along the tool body 202 and around the wet connector channel 602, and are fluidly separate from the wet connector channel 602. However, the bypass ports 604 can be positioned differently, such as unevenly about the wet connector channel 602. The bypass ports 604 fluidly connect to lateral port openings 606 in an outer surface of the tool body 202, for example, to allow circulation of fluid into the wellbore. The bypass ports 604, lateral port openings 606, or both, can be controlled to open and close with selectively controllable valves, for example, which can open and close the bypass ports 604 or lateral port openings 606 based on instructions from a controller (not shown).

The bypass ports 604 extend longitudinally along a majority of the longitudinal length of the tool body 202 until the ports 604 reach the lateral port openings 606 in the tool body 202. The lateral port openings 606 are positioned longitudinally downhole of the probe pads. In some implementations, the bypass ports 604 extend to and connect to a fluid supply at an uphole or tophole location, and selectively control circulation of a fluid from the fluid supply. The fluid supply can include a well kill fluid, acid treatment fluid, or another fluid type that can be circulated into the wellbore downhole of the probe module 210. In some examples, the bypass ports 604 allow for the introduction of acid treatment fluid or freeing acid pills in the event of a stuck tool during an operation of a well in the wellbore. In some instances, the capability to circulate fluid with the bypass ports 604 allows for an extended sampling time while the tubing string is stationary in a wellbore, such as across a tight formation in a high over balance environment. This additional sampling time promotes a cleaner formation fluid sample with less risk of a well tool on the tubing string becoming temporarily or permanently stuck.

Figure 7:
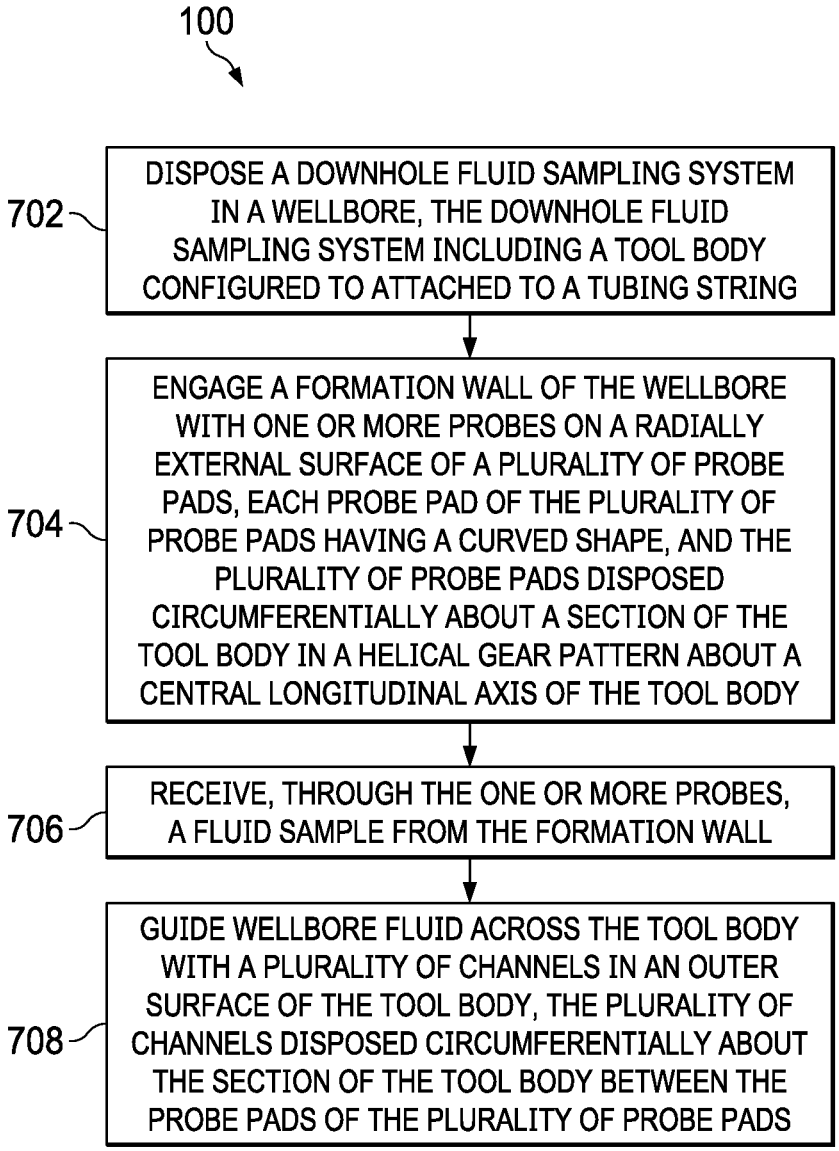
FIG. 7 is a flowchart describing an example method for sampling fluid downhole in a wellbore.

FIG. 7 is a flowchart describing an example method 700 for sampling fluid downhole in a wellbore, for example, performed by the example well tool 200 of FIGS. 2 to 6 in the example wellbore 102 of FIG. 1. At 702, a well tool defining a downhole fluid sampling system is disposed in a wellbore. The downhole fluid sampling system includes a tool body that can attach to a tubing string. At 704, one or more probes on a radially external surface of a plurality of probe pads engage a formation wall of the wellbore. Each probe pad has a curved shape, and the probe pads are disposed circumferentially about a section of the tool body in a helical gear pattern about a central longitudinal axis of the tool body. At 706, a fluid sample is received from the formation wall through the one or more probes. At 708, a wellbore fluid is guided across the tool body with a plurality of channels in an outer surface of the tool body. The channels are disposed circumferentially about the section of the tool body between the probe pads. In some implementations, the probe pads are radially extended from the tool body from a first, retracted position to a second, radially extended position, and engaging the probe pads occurs in response to this radial extension of the probe pads. In certain implementations, a fluid can be circulated downhole of the probe pads through one or more bypass ports extending within and longitudinally along the tool body, where the bypass ports include lateral port openings in an outer surface of the tool body leading to the wellbore. The circulated fluid can include well kill fluid, acid treatment fluid, or other well treatment fluid through the one or more bypass ports and into the wellbore downhole of the probe pads.

A number of implementations have been described. Nevertheless, it will be understood that various modifications may be made without departing from the spirit and scope of the disclosure.

What is claimed is:

1. A downhole fluid sampling system, comprising:

a tool body configured to attach to a tubing string;

a plurality of probe pads each having a curved shape and disposed circumferentially about a section of the tool body in a helical gear pattern about a central longitudinal axis of the tool body, each probe pad of the plurality of probe pads comprising multiple probes on an external surface of the respective probe pad, and each probe of the multiple probes is configured to contact and engage a wall of a wellbore and receive a flow of formation fluid from the wall of the wellbore, wherein the plurality of probe pads are connected to the tool body with probe arms, the plurality of probe pads configured to radially extend away from the tool body from a first, retracted position to a second, radially extended position, wherein each probe pad is extendible in order to engage the multiple probes of each respective probe pad with the wall of the wellbore; and a plurality of channels in an outer surface of the tool body and disposed circumferentially about the section of the tool body between the probe pads of the plurality of probe pads, the plurality of channels configured to direct fluid flow along the tool body.

2. The downhole fluid sampling system of claim 1, comprising a hydraulic actuator system connected to the probe pads and configured to radially actuate the plurality of probe pads to the radially extended position.

3. The downhole fluid sampling system of claim 2, further comprising a mechanical pad retracting system connected to the probe pads, the mechanical pad retracting system configured to radially actuate the probe pads to the radially retracted position.

4. The downhole fluid sampling system of claim 3, wherein the mechanical pad retracting system comprises at least one spring, the at least one spring configured to radially retract at least one probe pad of the plurality of probe pads.

5. The downhole fluid sampling system of claim 1, wherein the probe pads of the plurality of probe pads are distributed evenly about the section of the tool body.

6. The downhole fluid sampling system of claim 1, wherein the plurality of probe pads comprises four probe pads.

7. The downhole fluid sampling system of claim 1, wherein each probe pad of the plurality of probe pads comprises three probes.

8. The downhole fluid sampling system of claim 1, further comprising:

a wet connector channel extending within and longitudinally along the tool body; and one or more bypass ports extending within and longitudinally along the tool body, the one or more bypass ports being fluidly separate from the wet connector channel, the one or more bypass ports comprising one or more lateral port openings in an outer surface of the tool body.

9. The downhole fluid sampling system of claim 8, wherein the one or more bypass ports comprises four bypass ports along a majority of the longitudinal length of the tool body.

10. The downhole fluid sampling system of claim 8, wherein the one or more lateral port openings are positioned longitudinally downhole of the probe pads.

11. The downhole fluid sampling system of claim 1, wherein each channel of the plurality of channels comprises a concave profile configured to promote fluid flow along the respective channel.

12. The downhole fluid sampling system of claim 1, wherein the plurality of probe pads are at least partially flexible to match an inner surface profile of the wall of the wellbore.

13. A method for sampling fluid downhole in a wellbore, the method comprising:

disposing a downhole fluid sampling system in a wellbore, the downhole fluid sampling system comprising a tool body configured to attached to a tubing string;

radially extending a plurality of probe pads from the tool body from a first, retracted position to a second, radially extended position;

engaging, in response to the radially extending of the plurality of probe pads, a formation wall of the wellbore with multiple probes on a radially external surface of the plurality of probe pads, each probe pad of the plurality of probe pads having a curved shape and comprising multiple probes, wherein each probe pad of the plurality of probe pads is extendible in order to engage the multiple probes of each respective probe pad with the wall of the wellbore, and the plurality of probe pads disposed circumferentially about a section of the tool body in a helical gear pattern about a central longitudinal axis of the tool body;

receiving, through the multiple probes, a fluid sample from the formation wall; and guiding wellbore fluid across the tool body with a plurality of channels in an outer surface of the tool body, the plurality of channels disposed circumferentially about the section of the tool body between the probe pads of the plurality of probe pads.

14. The method of claim 13, wherein radially extending the plurality of probe pads comprises actuating a hydraulic actuator system coupled to the plurality of probe pads to radially extend the plurality of probe pads to the second, extended position.

15. The method of claim 13, further comprising, in response to radially extending the plurality of probe pads, radially retracting the plurality of probe pads with a mechanical pad retracting system to the first, retracted position.

16. The method of claim 13, comprising circulating fluid downhole of the probe pads through one or more bypass ports extending within and longitudinally along the tool body, the one or more bypass ports comprising one or more lateral port openings in an outer surface of the tool body.

17. The method of claim 16, wherein circulating fluid downhole of the probe pads through the one or more bypass ports comprises circulating well kill fluid through the one or more bypass ports and into the wellbore downhole of the probe pads.

18. A downhole fluid sampling system, comprising:

a tool body configured to attach to a tubing string;

a central channel extending within and longitudinally along the tool body;

one or more bypass ports extending within and longitudinally along the tool body, the one or more bypass ports being fluidly separate from the central channel, the one or more bypass ports comprising one or more lateral port openings in an outer surface of the tool body; and a plurality of probe pads each having a curved shape and disposed circumferentially about a section of the tool body in a helical gear pattern about a central longitudinal axis of the tool body, each probe pad of the plurality of probe pads comprising multiple probes on an external surface of the respective probe pad, and each probe of the multiple probes is configured to contact and engage a wall of a wellbore and receive a flow of formation fluid from the wall of the wellbore, wherein the plurality of probe pads are connected to the tool body with probe arms, the plurality of probe pads configured to radially extend away from the tool body from a first, retracted position to a second, radially extended position, and each probe pad is extendible in order to engage the multiple probes of each respective probe pad with the wall of the wellbore.

19. The downhole fluid sampling system of claim 18, comprising a plurality of channels in an outer surface of the tool body and disposed circumferentially about the section of the tool body between the probe pads of the plurality of probe pads, the plurality of channels configured to direct fluid flow along the tool body.

20. The downhole fluid sampling system of claim 18, wherein the plurality of probe pads are at least partially flexible to match an inner surface profile of the wall of the wellbore.

* * * * *